US007752038B2

(12) United States Patent
Laaksonen et al.

(10) Patent No.: US 7,752,038 B2
(45) Date of Patent: Jul. 6, 2010

(54) PITCH LAG ESTIMATION

(75) Inventors: Lasse Laaksonen, Nokia (FI); Anssi Ramo, Tampere (FI); Adriana Vasilache, Tampere (FI)

(73) Assignee: Nokia Corporation, Espoo (FI)

( * ) Notice: Subject to any disclaimer, the term of this patent is extended or adjusted under 35 U.S.C. 154(b) by 871 days.

(21) Appl. No.: 11/580,690

(22) Filed: Oct. 13, 2006

(65) Prior Publication Data

US 2008/0091418 A1 Apr. 17, 2008

(51) Int. Cl.
*G10L 11/04* (2006.01)
*G10L 19/00* (2006.01)

(52) U.S. Cl. ..... 704/207; 704/216; 704/217

(58) Field of Classification Search ..... None
See application file for complete search history.

(56) References Cited

U.S. PATENT DOCUMENTS 5,819,209 A * 10/1998 Inoue ..... 704/207
5,946,650 A * 8/1999 Wei ..... 704/207
6,208,958 B1 * 3/2001 Cho et al. ..... 704/207
6,804,639 B1 * 10/2004 Ehara ..... 704/223

OTHER PUBLICATIONS

R. Salami, et al; "Description of ITU-T Recommendation G.729 Annex A: Reduced Complexity 8 kbit/s CS-ACELP Codec;" IEEE International Conference: Acoustics, Speech and Signal Processing; Munich, Germany Apr. 21-24, 1997; vol. 2, pp. 775-778.
"Source-Controlled Variable-Rate Multimode Wideband Speech Codec (VMR-WB), Service Options 62 and 63 for Spread Spectrum Systems;" 3GPP2 C.S0052-A, Version 1.0; Apr. 22, 2005.
"A Robust Algorithm for Pitch Tracking (RAPT);" in Speech Coding and synthesis, Elsevier Science; D. Talkin; 1995; pp. 495-518.

* cited by examiner

*Primary Examiner*—Matthew J Sked
(74) *Attorney, Agent, or Firm*—Alfred A. Fressola; Ware, Fressola, Van Der Sluys & Adolphson LLP

(57) ABSTRACT

Autocorrelation values are determined as a basis for an estimation of a pitch lag in a segment of an audio signal. A first considered delay range for the autocorrelation computations is divided into a first set of sections, and first autocorrelation values are determined for delays in a plurality of sections of this first set of sections. A second considered delay range for the autocorrelation computations is divided into a second set of sections such that sections of the first set and sections of the second set are overlapping. Second autocorrelation values are determined for delays in a plurality of sections of this second set of sections.

31 Claims, 6 Drawing Sheets

PITCH LAG ESTIMATION

FIELD OF THE INVENTION

The invention relates to the estimation of pitch lags in audio signals.

BACKGROUND OF THE INVENTION

Pitch is the fundamental frequency of a speech signal. It is one of the key parameters in speech coding and processing. Applications making use of pitch detection include speech enhancement, automatic speech recognition and understanding, analysis and modeling of prosody, as well as speech coding, in particular low bit-rate speech coding. The reliability of the pitch detection is often a decisive factor for the output quality of the overall system.

Typically, speech codecs process speech in segments of 10-30 ms. These segments are referred to as frames. Frames are often further divided into segments having a length of 5-10 ms called sub frames for different purposes.

The pitch is directly related to the pitch lag, which is the cycle duration of a signal at the fundamental frequency. The pitch lag can be determined for example by applying autocorrelation computations to a segment of an audio signal. In these autocorrelation computations, samples of the original audio signal segment are multiplied with aligned samples of the same audio signal segment, which has been delayed by a respective amount. The sum over the products resulting with a specific delay is a correlation value. The highest correlation value results with the delay, which corresponds to the pitch lag. The pitch lag is also referred to as pitch delay.

Before the highest correlation value is determined, the correlation values may be pre-processed to increase the accuracy of the result. A range of considered delays may also be divided into sections, and correlation values may be determined for delays in all or some of these sections. The autocorrelation computations may differ between the sections for instance in the number of samples that are considered. Further, the sectioning may be exploited in a pre-processing that is applied to the correlation values before the highest correlation value is determined.

A pitch track is a sequence of determined pitch lags for a sequence of segments of an audio signal.

The framework of an employed audio processing system sets the requirements for the pitch detection. Especially for conversational speech coding solutions, the complexity and delay requirements are often quite strict. Moreover, the accuracy of the pitch estimates and the stability of the pitch track is an important issue in many audio processing systems.

Accurate pitch estimation is a difficult task. While a pitch detection of low complexity may be able to provide generally very reliable pitch estimates, it often fails to maintain a stable pitch track. Very effective pitch estimation can be achieved with complex approaches, but these often produce pitch tracks that are not quite optimal in a used framework and/or that introduce too much delay for conversational applications.

SUMMARY

The invention is suited to enhance conventional pitch estimation approaches.

A proposed method comprises determining first autocorrelation values for a segment of an audio signal. A first considered delay range is divided into a first set of sections, and the first autocorrelation values are determined for delays in a plurality of sections of this first set of sections. The method further comprises determining second autocorrelation values for the segment of an audio signal. A second considered delay range is divided into a second set of sections such that sections of the first set and sections of the second set are overlapping. The second autocorrelation values are determined for delays in a plurality of sections of this second set of sections. The method further comprises providing the determined first autocorrelation values and the determined second autocorrelation values for an estimation of a pitch lag in the segment of the audio signal.

A proposed apparatus comprises a correlator. The correlator is configured to determine first autocorrelation values for a segment of an audio signal, wherein a first considered delay range is divided into a first set of sections, the first autocorrelation values being determined for delays in a plurality of sections of this first set of sections. The correlator is further configured to determine second autocorrelation values for this segment of an audio signal, wherein a second considered delay range is divided into a second set of sections such that sections of the first set and sections of the second set are overlapping, the second autocorrelation values being determined for delays in a plurality of sections of this second set of sections. The correlator is further configured to provide the determined first autocorrelation values and the determined second autocorrelation values for an estimation of a pitch lag in the segment of the audio signal.

The apparatus could be for example a pitch analyzer like an open-loop pitch analyzer, an audio encoder or an entity comprising an audio encoder.

It is to be noted that the correlator and optional other components of the apparatus can be implemented in hardware and/or in software. If implemented in hardware, the apparatus could be for instance a chip or chipset, like an integrated circuit. If implemented in software, the components could be modules of a computer program code. In this case, the apparatus could also be for instance a memory storing the computer program code.

Moreover, a device is proposed, which comprises the proposed apparatus and in addition an audio input component.

The device could be for instance a wireless terminal or a base station of a wireless communication network, but equally any other device that performs an audio processing for which a pitch estimation is required. The audio input component of the device could be for example a microphone or an interface to another device supplying audio data.

Moreover, a system is proposed, which comprises an audio encoder including the proposed apparatus, and an audio decoder.

Finally, a computer program product is proposed, in which a program code is stored in a computer readable medium. The program code realizes the proposed method when executed by a processor.

The computer program product could be for example a separate memory device, or a memory that is to be integrated in an electronic device.

The invention is to be understood to cover such a computer program code also independently from a computer program product and a computer readable medium.

The invention proceeds from the consideration that while a sectioning of a delay range, which is considered for autocorrelation calculations applied to audio signal segments, can be beneficial for the pitch estimation, it also introduces discontinuities at the boundaries between the sections. It is therefore proposed that two sets of sections of the delay range are provided in parallel, and that autocorrelation values are determined for delays in sections of both sets. If the sections of one set are overlapping with the sections of the other set, the region of discontinuity between the sections in one set is always covered by a section in the other set.

As a result, an improved accuracy of the pitch estimation and an improved stability of the pitch track can be achieved. The improved performance of the pitch estimation also increases the output quality of an overall processing for which the pitch estimation is employed.

The invention can be used in the scope of various pitch estimation approaches. While more correlation values have to be determined than in existing pitch estimation approaches that employ a similar sectioning without the overlapping nature, many computations can be reused due to the overlapping nature of the sections so that the increase of complexity can be kept minimal.

The invention can be used for example in a new audio codec or for an enhancement of an existing audio codec, like a conventional code excited linear prediction (CELP) codec. In CELP speech coders, it is common to carry out the pitch estimation in two steps, an open-loop analysis to find the region of the correct pitch and a closed-loop analysis to select an optimal adaptive codebook index around the open-loop estimate. The invention is suited, for instance, to provide an enhancement for the open-loop analysis of such a CELP speech coder.

In an exemplary embodiment, the audio signal is divided into a sequence of frames, and each frame is further divided into a first half frame and a second half frame. The first half frame may then be a first segment of the audio signal for which first and second autocorrelation values are determined, while the second half frame may be a second segment of the audio signal for which first and second autocorrelation values are determined. In addition, a first half frame of a subsequent frame may be a third segment of the audio signal for which first and second autocorrelation values may be determined. The first half frame of the subsequent frame functions as a lookahead frame for the current frame.

The first set of sections and the second set of sections may comprise any suitable number of sections. The number of sections in both sets may be the same or different. Further, the delay range covered by both sets may be the same or somewhat different. Moreover, autocorrelation values may be determined for each section of a set or only for some sections of a set. In some situations, for example, very high fundamental frequencies corresponding to the section with the lowest delays may not be critical for the quality in a system. In an exemplary embodiment, both sets comprise four sections, and autocorrelation values are determined for delays in at least three sections of each set of sections.

In an exemplary embodiment, a strongest autocorrelation value is selected in each section of each set from among the provided autocorrelation values. The associated delays can then be considered as selected pitch lag candidates.

Before a strongest autocorrelation value is selected in each section of each set of sections, autocorrelation values could be reinforced based on pitch lags estimated for preceding frames.

After a strongest autocorrelation value has been selected in each section of each set of sections, the selected autocorrelation values could be reinforced based on a detection of pitch lag multiples in a respective set of sections. The delay range could be sectioned such that a section will not comprise pitch lag multiples. That is, the largest delay in a section is smaller than twice the smallest delay in this section. This ensures that pitch lag multiples have only to be searched from one section to the next.

After a strongest autocorrelation value has been selected in each section of each set of sections and optionally before or after some further processing of the selected autocorrelation values, the selected autocorrelation values that are stable across segments of the audio signal may be reinforced. The segments considered for stability could be two consecutive segments, but equally two segments having one or more other segments in between them. Stability may be considered for example across segments in a frame and a lookahead frame. Autocorrelation values that are stable in the same section across segments of the audio signal may be reinforced stronger than autocorrelation values that are stable in different sections across segments of the audio signal.

Such a section-wise stability reinforcement increases the stability of the output without introducing incorrect pitch lag candidates to the track.

The stability across segments can be determined for example by determining the coherence between a respective pair of autocorrelation values in two segments. That is, stability may be assumed if the values differ from each other by less than a predetermined amount.

In case the autocorrelation values are determined based on different amounts of samples for different sections or otherwise for different delays, it might be appropriate to normalize the values at the latest before any comparison of autocorrelations associated to different sections or delays, respectively, is performed.

It is to be understood that the features and steps of all presented embodiments can be combined in any suitable way.

It has further to be noted that the aspect of a section-wise reinforcement could also be implemented independently of the use of two sets of sections for the autocorrelation computations.

This could be realized by a method comprising determining autocorrelation values for a segment of an audio signal, wherein a considered delay range is divided into sections, the autocorrelation values being determined for delays in a plurality of these sections; selecting from the resulting autocorrelation values a strongest autocorrelation value in each section; reinforcing selected autocorrelation values that are stable across segments of the audio signal, wherein autocorrelation values that are stable in the same section across segments of the audio signal are reinforced stronger than autocorrelation values that are stable in different sections across segments of the audio signal; and providing the resulting autocorrelation values for an estimation of a pitch lag in the segment of the audio signal.

A corresponding computer program product could store program code which realizes this method when executed by a processor. A corresponding apparatus, device and system could comprise a correlator configured to perform such autocorrelation computations or means for performing such autocorrelation computations; a selection component configured to perform such a selection or means for performing such a selection; and a reinforcement component configured to perform such a reinforcement and to provide the resulting autocorrelation values or means for performing such a reinforcement and for providing the resulting autocorrelation values.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

DETAILED DESCRIPTION OF THE INVENTION

While the invention can be employed with various frameworks, a first embodiment of the invention will be presented by way of example as an enhancement of the speech coding defined in the 3GPP2 standard C.S0052-0, Version 1.0: "Source-Controlled Variable-Rate Multimode Wideband Speech Codec (VMR-WB), Service Option 62 for Spread Spectrum Systems", Jun. 11, 2004. The encoding techniques utilized according to this standard at full rate or half rate frames are modeled on the Algebraic CELP (ACELP) coding.

Figure 1:
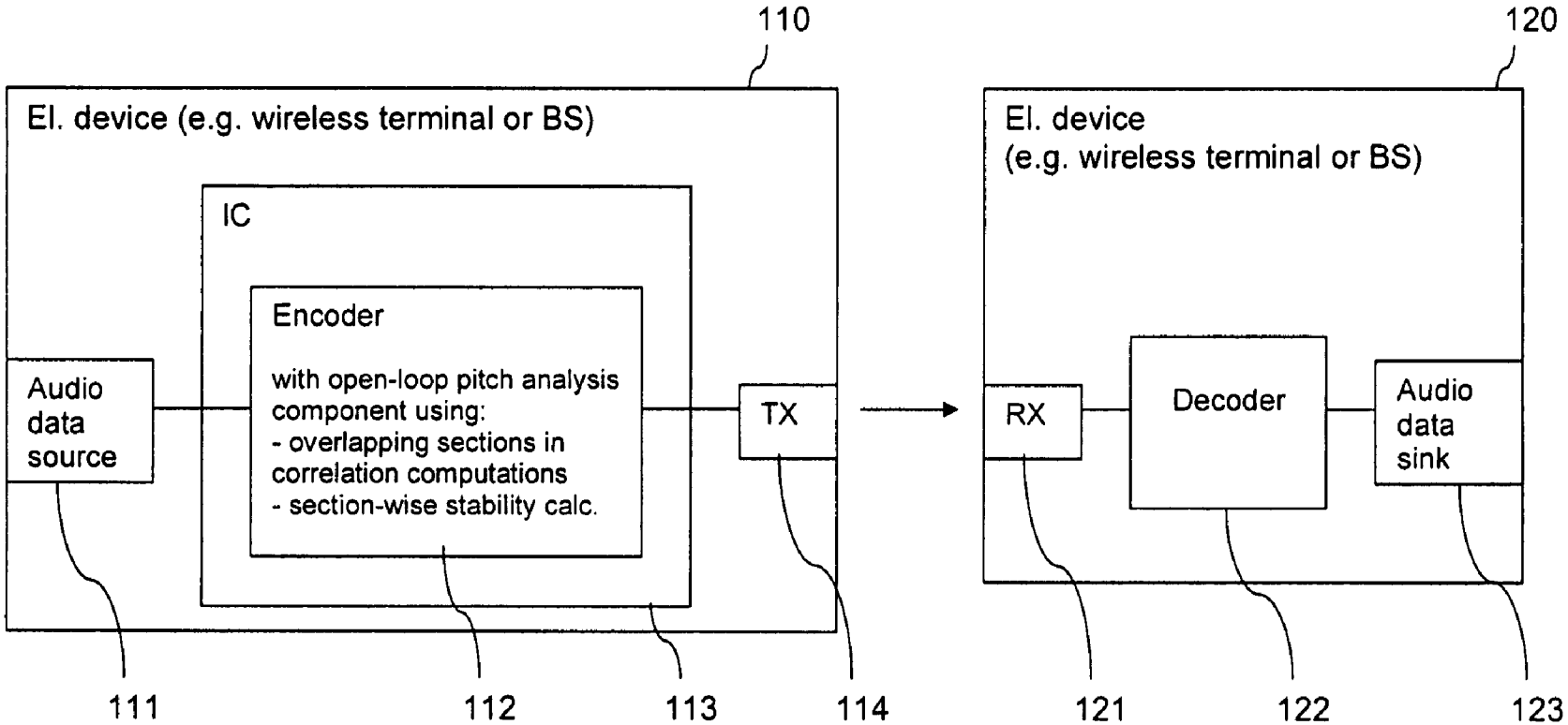
FIG. 1 is a schematic block diagram of a system according to an exemplary embodiment of the invention.

FIG. 1 is a schematic block diagram of a system, which enables an enhanced pitch tracking in accordance with the first embodiment of the invention. In the context of the present document, pitch tracking refers mainly to a pitch detection approach which provides more reliable pitch estimates by combining the temporal pitch information over successive segments of an audio signal. However, to facilitate certain coding methods and to avoid artifacts, a selection of pitch estimates which result in a stable overall pitch track during voiced speech is also desirable.

The system comprises a first electronic device 110 and a second electronic device 120. One of the devices 110, 120 could be for example a wireless terminal and the other device 120, 110 could be for example a base station of a wireless communication network that can be accessed by the wireless terminal via the air interface. Such a wireless communication network could be for example a mobile communication network, but equally a wireless local area network (WLAN), etc. Correspondingly, such a wireless terminal could be for example a mobile terminal, but equally any device suited to access a WLAN, etc.

The first electronic device 110 comprises an audio data source 111, which is linked via an encoder 112 to a transmission component (TX) 114. It is to be understood that the indicated connections can be realized via various other elements not shown.

If the first electronic device 110 is a wireless terminal, the audio data source 111 could be for example a microphone enabling a user to input analog audio signals. In this case, the audio data source 111 could be linked to the encoder 112 via processing components including an analog-to-digital converter. If the first electronic device 110 is a base station, the audio data source 111 could be for example an interface to other network components of the wireless communication network supplying digital audio signals. In both cases, the audio data source 111 could also be a memory storing digital audio signals.

The encoder 112 may be a circuit that is implemented in an integrated circuit (IC) 113. Other components, like a decoder, an analog-to-digital converter or a digital-to-analog converter etc., could be implemented in the same integrated circuit 113.

The second electronic device 120 comprises a receiving component (RX) 121, which is linked via a decoder 122 to an audio data sink 123. It is to be understood that the indicated connections can be realized via various other elements not shown.

If the second electronic device 120 is a wireless terminal, the audio data sink 123 could be for example a loudspeaker outputting analog audio signals. In this case, the decoder 122 could be linked to the audio data sink 123 via processing components including a digital-to-analog converter. If the second electronic device 120 is a base station, the audio data sink 123 could be for example an interface to other network components of the wireless communication network, to which digital audio signals are to be forwarded. In both cases, the audio data sink 123 could also be a memory storing digital audio signals.

Figure 2:
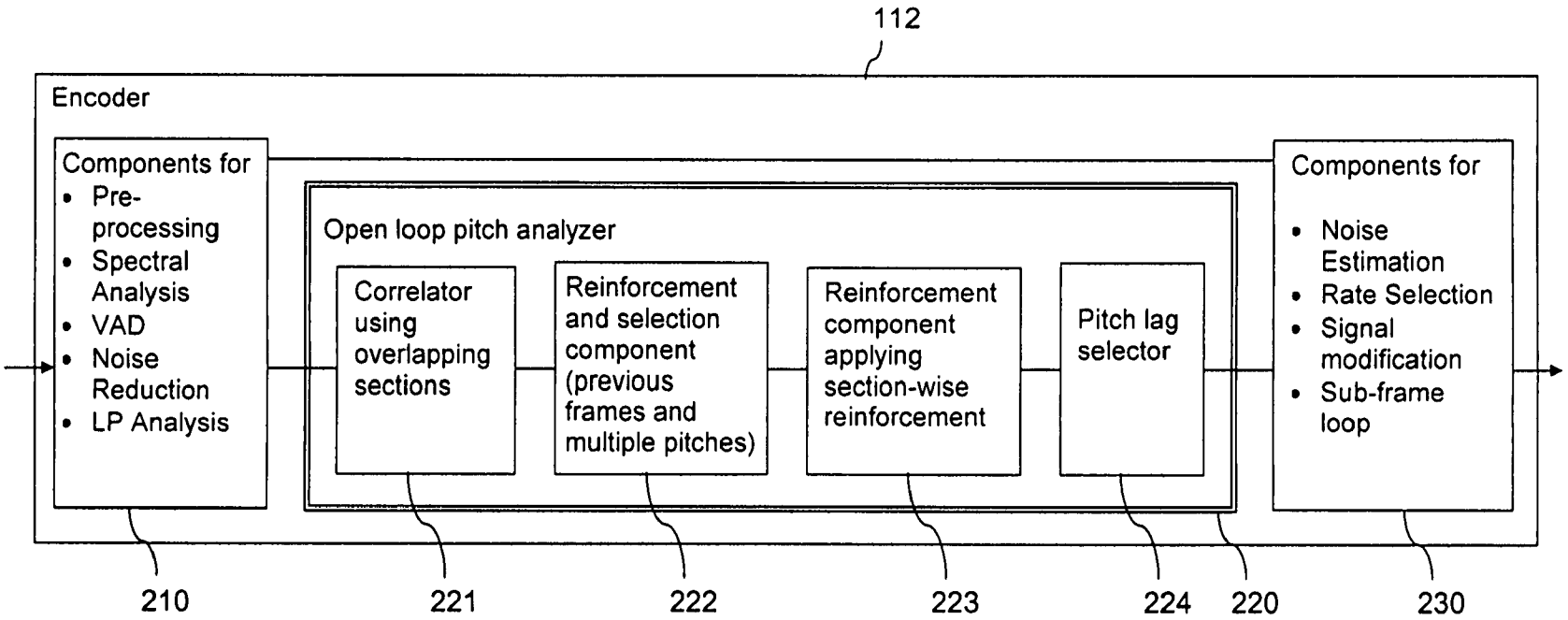
FIG. 2 is a schematic block diagram illustrating an exemplary encoder in the system of FIG. 1.

FIG. 2 is a schematic block diagram presenting details of the encoder 112 of the first electronic device 110.

The encoder 112 comprises a first block 210, which summarizes various components that are not considered in detail in this document.

The first block 210 is linked to an open-loop pitch analyzer 220, which is configured according to an embodiment of the invention. The open-loop pitch analyzer 220 includes a correlator 221, a reinforcement and selection component 222, a reinforcement component 223 and a pitch lag selector 224.

The open-loop pitch analyzer 220 is moreover linked to a further block 230, which summarizes again various components that are not considered in detail in this document.

Components of the first block 210 are also linked directly to components of the further block 230.

The encoder 112, the integrated circuit 113 or the open-loop pitch analyzer 220 could be seen as an exemplary apparatus according to the invention, while the first electronic device 110 could be seen as an exemplary device according to the invention.

Figure 3:
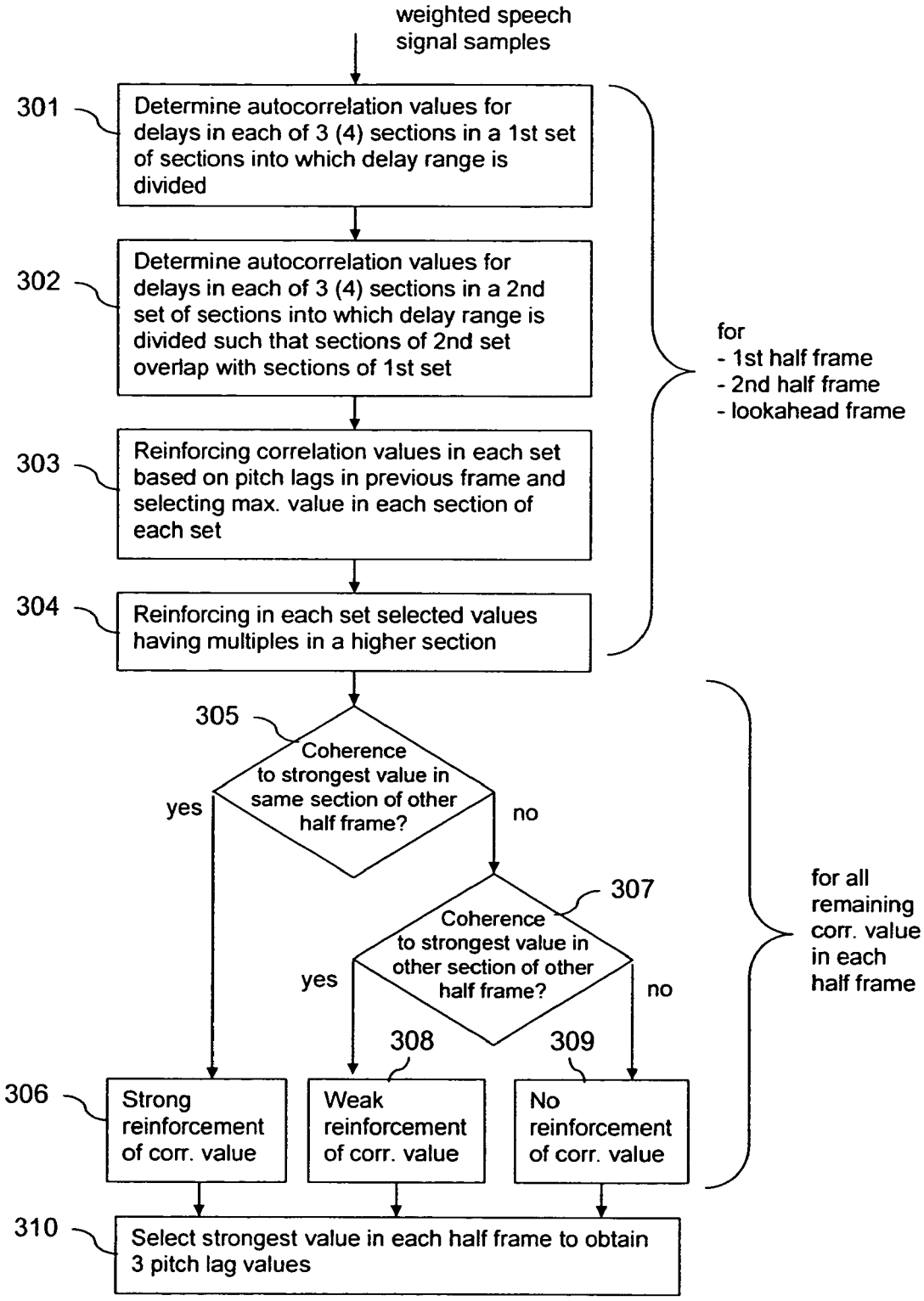
FIG. 3 is a flow chart illustrating an operation in the encoder of FIG. 2.

An operation in the system of FIG. 1 will now be described with reference to FIG. 3. FIG. 3 is a flow chart illustrating the operation in the open-loop pitch analyzer 220 of the encoder 112 of the first electronic device 110.

When a base station acting as a first electronic device 110 receives from the wireless communication network a digital audio signal via an interface acting as an audio data source 111 for transmission to a wireless terminal acting as a second electronic device 120, it provides the digital audio signal to the encoder 112. Similarly, when a wireless terminal acting as a first electronic device 110 receives an audio input via a microphone acting as an audio data source 111 for transmission to a service provider or to another wireless terminal acting as a second electronic device 120, it converts the analog audio signal into a digital audio signal and provides the digital audio signal to the encoder 112.

The components of the first block 210 take care of a preprocessing of the received digital audio signal, including sampling conversion, high-pass filtering and spectral preemphasis. The components of the first block 210 further perform a spectral analysis, which provides the energy per critical bands twice per frame. Moreover, they perform voice activity detection (VAD), noise reduction and an LP analysis resulting in LP synthesis filter coefficients. In addition, a perceptual weighting is performed by filtering the digital audio signal through a perceptual weighting filter derived from the LP synthesis filter coefficients, resulting in a weighted speech signal. Details of these processing steps can be found in the above mentioned standard C.S0052-0.

The first block 210 provides the weighted speech signal and other information to the open-loop pitch analyzer 220.

The open-loop pitch analyzer 220 performs an open-loop pitch analysis on the weighted signal decimated by two (steps 301-310). In this open-loop pitch analysis, the open-loop pitch analyzer 220 calculates three estimates of the pitch lag for each frame, one in each half frame of the present frame and one in the first half frame of the next frame, which is used as a lookahead frame. The three half frames correspond to a respective segment of an audio signal in the presented embodiment of the invention.

According to standard C.S0052-0, a pitch delay range (decimated by 2) is divided into four sections [10, 16], [17, 31], [32, 61], and [62, 115], and correlation values are determined for each of the three half frames at least for the delays in the latter three sections.

For the open-loop pitch analysis of the presented embodiment, in contrast, the pitch delay range is divided twice into four sections, which are overlapping. In this way, a region of discontinuity between the sections in one set is always covered by a section in the other set. The first set of sections may comprise for example the same sections as defined in standard C.S0052-0, namely [10, 16], [17, 31], [32, 61], and [62, 115]. The second set of sections may comprise for example the sections [12, 21], [22, 40], [41, 77], and [78, 115]. It is to be understood that both sets could be based on a different segmentation as well.

Figure 4:
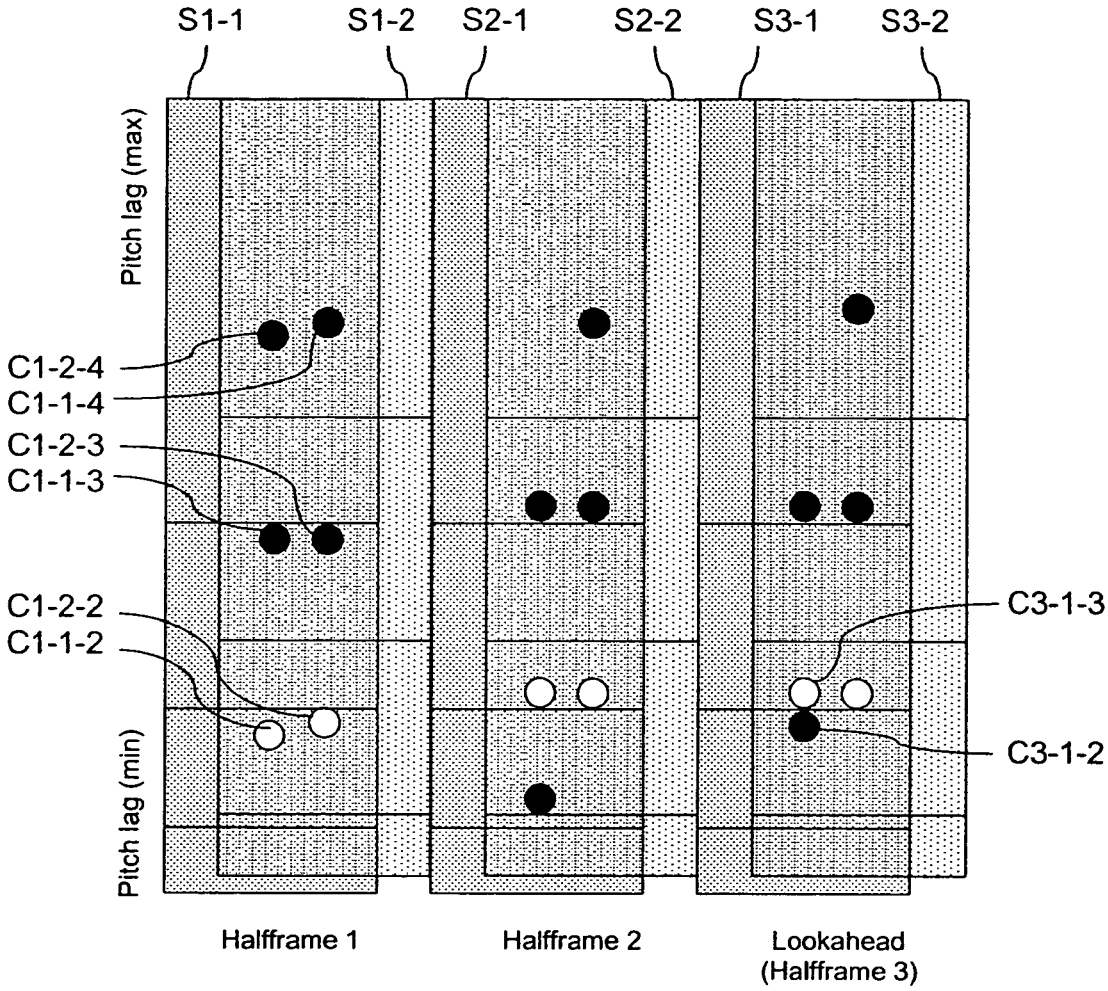
FIG. 4 is a diagram illustrating overlapping sections and a section-wise pitch lag selection used by the encoder of FIG. 2.

The twofold sectioning of the pitch delay range is illustrated in FIG. 4. The sectioning used for the first half frame is presented on the left hand side, the sectioning used for the second first half frame is presented in the middle, and the sectioning used for the lookahead frame is presented on the right hand side. The same sectioning is used for each of the three half frames.

A first set of four sections S1-1, S2-1, S3-1, which is based on the standard C.S0052-0, is represented for each half frame by four rectangles arranged on top of each other. A second set of four sections S1-2, S2-2, S3-2 is represented for each half frame by four rectangles arranged on top of each other. For illustration purposes, the respective second set S1-2, S2-2, S3-2 is slightly shifted to the right compared to the respective first set S1-1, S2-1, S3-1. The delay covered by the sections increases from bottom to top. It can be seen that the sections in a respective first set S1-1, S2-1, S3-1 and a respective second set S1-2, S2-2, S3-2 have different boundaries and that the sections are thus overlapping.

In standard C.S0052-0, the sections are selected such that they cannot include pitch lag multiples. If this principle of allowing no potential pitch lag multiples in any section is pursued for both sets of sections of the presented embodiment, the sections in one of the sets will not cover all the candidate values of the pitch delay. More specifically, in one of the sets, the section with the shortest delays will not cover those delays, which correspond to the highest pitch frequencies the estimator is allowed to search for. In the above presented exemplary second set, for instance, the smallest delays of 10 and 11 samples are not covered by the first section. Testing has demonstrated, though, that this artificial limitation does not affect the performance of the system. Moreover, it is also possible to overcome this limitation by adding one section to the second set of sections to cover also the highest pitch frequencies. In the case of the standard C.S0052-0 or any similar approach, however, the extra section in the second set of sections needs to adapt its range of delays to the usage decision of the shortest-delay section.

In the open-loop pitch analyzer 220, the correlator receives the weighted signal samples and applies autocorrelation calculations separately on each of two half frames of a frame and on a lookahead frame. That is, the samples of each half frame are multiplied with delayed samples of the same input signal and the resulting products are summed to obtain a correlation value. The delayed samples can be for example from the same half frame, from the previous half frame, or even the half frame before that, or from a combination of these. In addition, the correlation range may consider also some samples that are in the following half frame.

The delays for the autocorrelation calculations are selected for each half frame on the one hand from the second, third and fourth section of the first set of sections S1-1, S2-1, S3-1 (step 301).

The delays for the autocorrelation calculations are selected for each half frame on the other hand from the second, third and fourth section of the second set of sections S1-2, S2-2, S3-2 (step 302).

Under special circumstances, the first section of each set may also be considered.

The correlation values can be calculated for each set of sections for example according to the equation provided in standard C.S0052-0. Here, a correlation value is computed for each delay in a respective section by $$C(d) = \sum_{n=0}^{L_{sec}} s_{wd}(n) s_{wd}(n-d)$$

where $s_{wd}(n)$ is the weighted, decimated speech signal, where d are different delays in the section, where C(d) is the correlation at delay d, and where $L_{sec}$ is the summation limit, which may depend on the section to which the delay belongs.

Since correlation values are determined in two sets of sections, the total number of resulting correlation values C(d) is almost twice the number of correlation values C(d) resulting according to standard C.S0052-0.

Next, the reinforcement and selection component 222 performs a first reinforcement of correlation values for each set of sections of each half frame. In this first reinforcement, the correlation values are weighted to emphasize the correlation values that correspond to delays in the neighborhood of pitch lags determined for the preceding frame (step 303). Next, the maximum of the weighted correlation values is selected for each section of each set, and the associated delay is identified as a pitch delay candidate. The selected correlation values are moreover normalized, in order to compensate for different summation limits $L_{sec}$ that may have been used in the autocorrelation calculations for different sections. Exemplary details of the weighting, the selection and the normalization for one set of sections can be taken from standard C.S0052-0.

The remaining processing is performed using only the normalized correlation values.

In FIG. 4, eighteen selected correlation values are illustrated by dots (black and white) at exemplary associated delay positions, with one correlation value for each of the second, third and fourth section in both sets of sections for each half frame.

For example, for the first set of the first half frame, correlation value C1-1-2 remains for the second section, correlation value C1-1-3 remains for the third section and correlation value C1-1-4 remains for the fourth section. For the second set of the first half frame, correlation value C1-2-2 remains for the second section, correlation value C1-2-3 remains for the third section and correlation value C1-2-4 remains for the fourth section, etc.

The number of selected correlation values is twice the number of correlation values remaining at this stage according to standard C.S0052-0.

The reinforcement and selection component 222 moreover performs a second reinforcement of correlation values for each set of each half frame in order to avoid selecting pitch lag multiples (step 304). In this second reinforcement, the selected correlation values that are associated to a delay in a lower section are further emphasized, if a multiple of this delay is in the neighborhood of a delay associated to a selected correlation value in a higher section of the same set of sections. Exemplary details for such a reinforcement for one set of sections can be taken from standard C.S0052-0.

The reinforcement component 223 performs a third reinforcement of the correlation values, which differs from a third reinforcement defined in standard C.S0052-0.

Standard C.S0052-0 defines that if a correlation value in one half frame has a coherent correlation value in any section of another half frame, it is further emphasized.

The correlation values of two half frames are considered coherent if the following condition is satisfied:

$$(\text{max_value} < 1.4\ \text{min_value})\ \text{AND}\ ((\text{max_value} - \text{min_value}) < 14)$$

wherein max_value and min_value denote the maximum and minimum of the two correlation values, respectively.

A problem resulting with this approach is potential selection of the second best track for the current frame, when the best track crosses a section boundary. Since the crossing may introduce a discontinuity to one of the tracks, a wrong correlation value can get reinforced and therefore be selected.

Reinforcement component 223 of FIG. 2, in contrast, emphasizes the selected correlation value section-wise, in order to strengthen the pitch delay candidates that produce the most stable pitch track for the current frame.

If a considered correlation value in a section of one half frame is coherent to the maximum correlation value of the same set in another half frame, and this maximum correlation value belongs to the same section as the considered correlation value, the considered correlation value is emphasized strongly (steps 305, 306). If a considered correlation value in a section of one half frame is coherent to the maximum correlation value of the same set in another half frame, and this maximum correlation value belongs to another section than the considered correlation value, or the considered correlation value is coherent to the maximum correlation value of another set in another half frame, the considered correlation value is emphasized only weakly (steps 305, 307, 308). Candidates showing no coherence to a maximum correlation value in either the same set or another set of another half frame are not reinforced (steps 305, 307, 309).

The section-wise stability measure thus applies more reinforcement to those neighboring candidates that lie in the same section as the best candidate of each half frame, while a more modest reinforcement is applied to those candidates that are in a different section. This way, all the neighboring candidates showing stability to the best candidate get a positive weight for the final selection, while it is ensured that more weight is given for those candidates that are expected legit than for the potentially incorrect candidates.

While the dots in FIG. 4 represent all selected correlation values, the white dots mark the highest correlation value in each set for each half frame after the third reinforcement. In the first half frame, these are for instance correlation value C1-1-2 for the first set S1-1 and correlation value C1-2-2 for the second set S2-1.

Without the section-wise stability scheme, the highest correlation value could be in some cases a correlation value that is associated to a suboptimal delay in view of a stable pitch track, for example correlation value C3-1-2 in the first set S3-1 of the lookahead frame. When the section-wise stability scheme is used, in contrast, the optimal pitch lag associated to correlation value C3-1-3 in the first set S3-1 of the lookahead frame is more likely to be selected.

Finally, the pitch lag selector 224 selects for each half frame the maximum correlation value from all sections in both sets of sections (step 310). The pitch lag selector 224 provides the three delays, which are associated to the three final correlation values, as the final pitch lags to the second block 230. The three final pitch lags form the pitch track for the current frame.

The components of the second block 230 perform a noise estimation and provide a corresponding feedback to the first block 210. Further, they apply a signal modification, which modifies the original signal to make the encoding easier for voiced encoding types, and which contains an inherent classifier for classification of those frames that are suitable for half rate voiced encoding. The components of the second block 230 further perform a rate selection determining the other encoding techniques. Moreover, they process the active speech in a sub-frame loop using an appropriate coding technique. This processing comprises a closed-loop pitch analysis, which proceeds from the pitch lags determined in the above described open-loop pitch analysis. The components of the second block 230 further take care of comfort noise generation. The results of the speech coding and of the comfort noise generation are provided as an output bit-stream of the encoder 112.

The output bit-stream can be transmitted by the transmission component 114 via the air interface to the second electronic device 120. The receiving component 121 of the second electronic device 120 receives the bit-stream and provides it to the decoder 122. The decoder 122 decodes the bitstream and provides the resulting decoded audio signal to the audio data sink 123 for presentation, transmission or storage.

Compared to the approach of standard C.S0052-0, the use of overlapping sections in the correlation computations and the use of section-wise stability calculations in the presented embodiment of the invention result in an improved accuracy and stability of the pitch track in certain problematic speech segments. This, in turn, is suited to increase the output speech quality.

Figure 5:
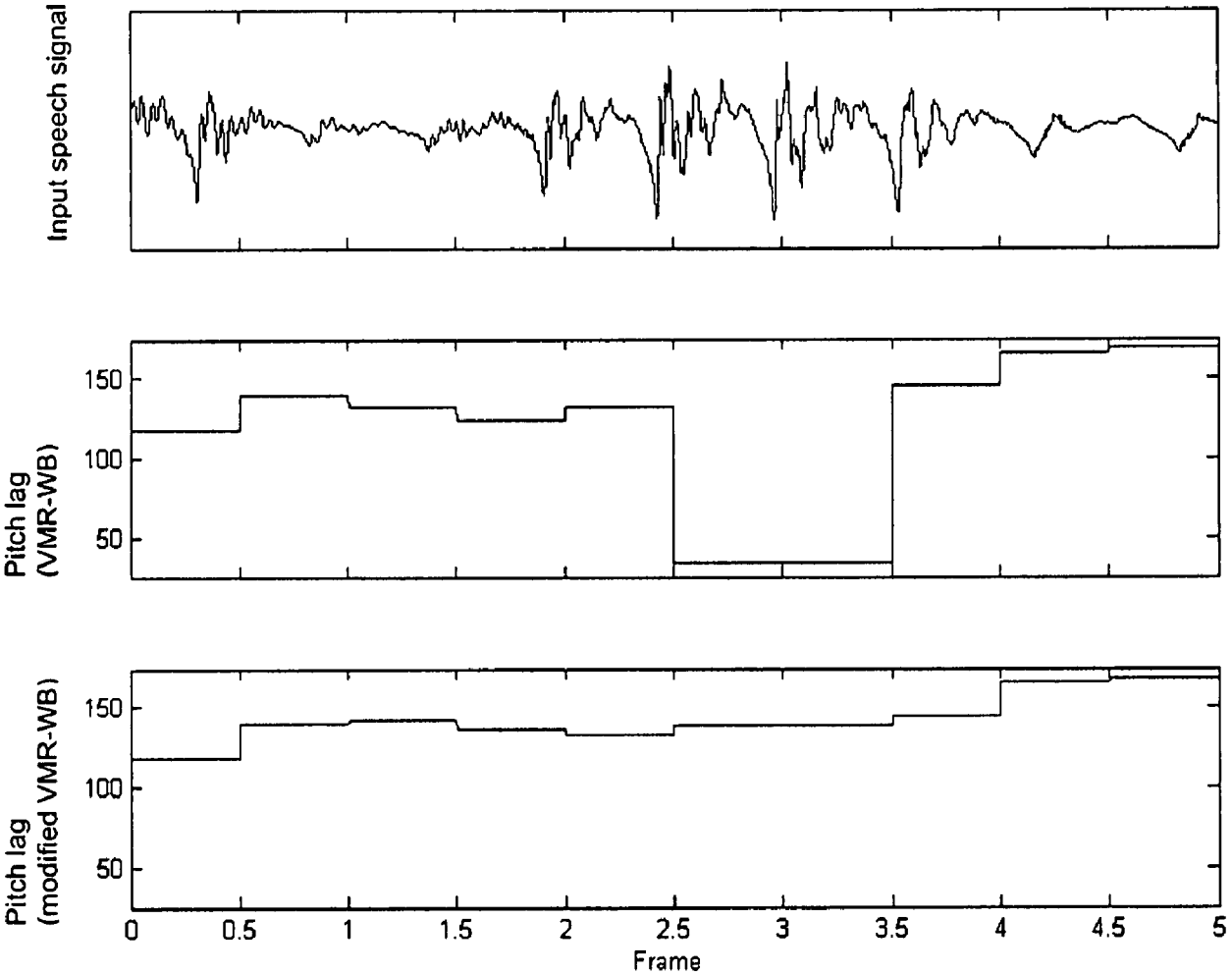
FIG. 5 is a diagram presenting a comparison between the performance of a standardized VMR-WB pitch estimation and of a pitch estimation making use of an embodiment of the invention.

FIG. 5 presents a comparison between the VMR-WB pitch estimation of standard C.S0052-0 without the presented modifications and with the presented modifications.

A first diagram at the top of FIG. 5 shows an exemplary input speech signal over five frames. A second diagram in the middle of FIG. 5 illustrates the track of the pitch lag resulting with the VMR-WB pitch estimation of standard C.S0052-0 when applied to the depicted input speech signal. Most of the time, the VMR-WB pitch estimation has a very good performance. In some situations, however, the VMR-WB pitch track may be unstable, like in the second half frame of frame 2 and the first half frame of frame 3. A third diagram at the bottom of FIG. 5 illustrates the track of the pitch lag resulting with the above presented modified VMR-WB pitch estimation when applied to the depicted input speech signal. It can be seen that the modified VMR-WB pitch estimation is suited to provide a reliable and stable pitch track also in many of the cases, in which the VMR-WB pitch estimation of standard C.S0052-0 fails.

A similar effect can be expected, when the invention is used in conjunction with some other type of pitch estimation than the pitch estimation of standard C.S0052-0.

The functions illustrated by the correlator 221 can also be viewed as means for determining first autocorrelation values for a segment of an audio signal, wherein a first considered delay range is divided into a first set of sections, the first autocorrelation values being determined for delays in a plurality of sections of the first set of sections. The functions illustrated by the correlator 221 can equally be viewed as means for determining second autocorrelation values for the segment of an audio signal, wherein a second considered delay range is divided into a second set of sections such that sections of the first set and sections of the second set are overlapping, the second autocorrelation values being determined for delays in a plurality of sections of the second set of sections. The functions illustrated by the correlator 221 can moreover be viewed as means for providing the determined first autocorrelation values and the determined second autocorrelation values for an estimation of a pitch lag in the segment of the audio signal.

The functions illustrated by the reinforcement and selection component 222 can also be viewed as means for selecting from provided autocorrelation values a strongest autocorrelation value in each section of each set of sections.

The functions illustrated by the reinforcement component 223 can also be viewed as means for reinforcing selected autocorrelation values that are stable across segments of the audio signal, wherein autocorrelation values that are stable in the same section across segments of the audio signal are reinforced stronger than autocorrelation values that are stable in different sections across segments of the audio signal.

Figure 6:
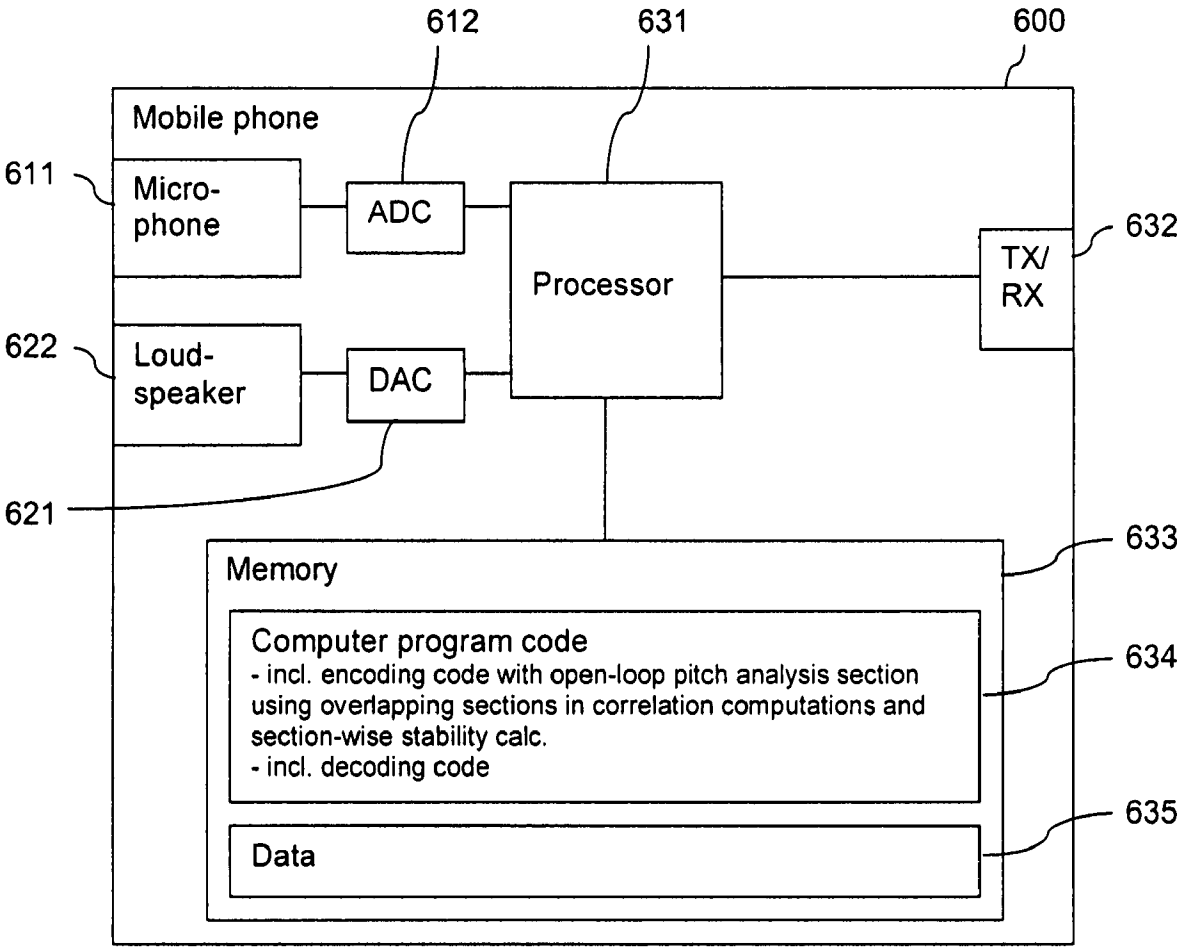
FIG. 6 is a schematic block diagram of a device according to an exemplary embodiment of the invention.

FIG. 6 is a schematic block diagram of a device 600 according to another embodiment of the invention.

The device 600 could be for example a mobile phone. It comprises a microphone 611, which is linked via an analog-to-digital converter (ADC) 612 to a processor 631. The processor 631 is further linked via a digital-to-analog converter (DAC) 621 to loudspeakers 622. The processor 631 is further linked to a transceiver (RX/TX) 6342 and to a memory 633. It is to be understood that the indicated connections can be realized via various other elements not shown.

The processor 631 is configured to execute computer program code. The memory 633 includes a portion 634 for computer program code and a portion for data. The stored computer program code includes encoding code and decoding code. The processor 631 may retrieve for example computer program code for execution from the memory 633 whenever needed. It is to be understood that various other computer program code is available for execution as well, like an operating program code and program code for various applications.

The stored encoding program code or the processor 631 in combination with the memory 633 could be seen as an exemplary apparatus according to the invention. The memory 633 could also be seen as an exemplary computer program product according to the invention.

When a user selects a function of the mobile phone 600, which requires an encoding of an audio input, an application providing this function causes the processor 631 to retrieve the encoding code from the memory 633.

When the user now inputs an analog audio signal, like speech, via the microphone 611, the analog audio signal is converted by the analog-to-digital converter 612 into a digital speech signal and provided to the processor 631. The processor 631 executes the retrieved encoding software to encode the digital speech signal. The encoded speech signal is either stored in the data storage portion 635 of the memory 633 for later use or transmitted by the transceiver 632 to a base station of a mobile communication network.

The encoding could be based again on the VMR-WB codec of standard C.S0052-0 with similar modifications as described with reference to the first embodiment. In this case, the processing described with reference to FIG. 3 is just performed by executed computer program code and not by circuitry. Alternatively, the encoding could be based on some other encoding approach that is enhanced by using a correlation based on at least two sets of overlapping sections and/or a section-wise reinforcement.

The processor 631 may further retrieve the decoding software from the memory 633 and execute it to decode an encoded speech signal that is either received via the transceiver 632 or retrieved from the data storage portion 635 of the memory 633. The decoded digital speech signal is then converted by the digital-to-analog converter 621 into an analog audio signal and presented to a user via the loudspeakers 622. Alternatively, the decoded digital speech signal could be stored in the data storage portion 635 of the memory 633.

On the whole, the overlapping sections in the presented embodiments guarantee that the best tracks are always included in one section, and the section-wise stability reinforcement in the presented embodiments then biases these tracks accordingly.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures.

What is claimed is:

1. A method comprising:

determining first autocorrelation values for a segment of an audio signal, wherein a first considered delay range is divided into a first set of a plurality of sections, said first autocorrelation values being determined for delays in a plurality of sections of said first set of sections;

determining second autocorrelation values for said segment of an audio signal, wherein a second considered delay range is divided into a second set of a plurality of sections such that sections of said first set and sections of said second set are overlapping, said second autocorrelation values being determined for delays in a plurality of sections of said second set of sections; and providing said determined first autocorrelation values and said determined second autocorrelation values for an estimation of a pitch lag in said segment of said audio signal.

2. The method according to claim 1, wherein said audio signal is divided into a sequence of frames, and wherein each frame is further divided into a first half frame and a second half frame, and wherein for each frame first and second autocorrelation values are determined separately for said first half frame of said frame as a first segment of said audio signal, for said second half frame of said frame as a second segment of said audio signal and for a first half frame of a subsequent frame as a third segment of said audio signal.

3. The method according to claim 1, wherein each of said first set of sections and said second set of sections comprises four sections and wherein said autocorrelation values are determined for delays in at least three sections of each set of sections.

4. The method according to claim 1, wherein said sections in said first set of sections and in said second set of sections are selected such that a section does not comprise pitch lag multiples.

5. The method according to claim 1, further comprising selecting from said provided autocorrelation values a strongest autocorrelation value in each section of each set of sections.

6. The method according to claim 5, further comprising reinforcing autocorrelation values based on pitch lags estimated for preceding frames before a strongest autocorrelation value is selected in each section of each set of sections.

7. The method according to claim 5, further comprising reinforcing selected autocorrelation values based on a detection of pitch lag multiples for a respective set of sections.

8. The method according to claim 5, further comprising reinforcing selected autocorrelation values that are stable across segments of said audio signal, wherein autocorrelation values that are stable in the same section across segments of said audio signal are reinforced stronger than autocorrelation values that are stable in different sections across segments of said audio signal.

9. The method according to claim 1, wherein said autocorrelation values are determined in the scope of an open-loop pitch analysis.

10. An apparatus comprising a correlator, said correlator being configured to determine first autocorrelation values for a segment of an audio signal, wherein a first considered delay range is divided into a first set of a plurality of sections, said first autocorrelation values being determined for delays in a plurality of sections of said first set of sections;

said correlator being configured to determine second autocorrelation values for said segment of an audio signal, wherein a second considered delay range is divided into a second set of a plurality of sections such that sections of said first set and sections of said second set are overlapping, said second autocorrelation values being determined for delays in a plurality of sections of said second set of sections; and said correlator being configured to provide said determined first autocorrelation values and said determined second autocorrelation values for an estimation of a pitch lag in said segment of said audio signal.

11. The apparatus according to claim 10, wherein said audio signal is divided into a sequence of frames, and wherein each frame is further divided into a first half frame and a second half frame, and wherein said correlator is configured to determine for each frame first and second autocorrelation values separately for said first half frame of said frame as a first segment of said audio signal, for said second half frame of said frame as a second segment of said audio signal and for a first half frame of a subsequent frame as a third segment of said audio signal.

12. The apparatus according to claim 10, wherein said first set of sections and said second set of sections each comprises four sections and wherein said correlator is configured to determine said autocorrelation values for delays in at least three sections of each set of sections.

13. The apparatus according to claim 10, wherein said sections in said first set of sections and in said second set of sections are selected such that a section does not comprise pitch lag multiples.

14. The apparatus according to claim 10, further comprising a selection component configured to select from said provided autocorrelation values a strongest autocorrelation value in each section of each set of sections.

15. The apparatus according to claim 14, further comprising a reinforcement component configured to reinforce selected autocorrelation values that are stable across segments of said audio signal, wherein autocorrelation values that are stable in the same section across segments of said audio signal are reinforced stronger than autocorrelation values that are stable in different sections across segments of said audio signal.

16. The apparatus according to claim 10, wherein said apparatus is an open-loop pitch analyser.

17. The apparatus according to claim 10, wherein said apparatus is an audio encoder.

18. A device comprising:

the apparatus according to claim 10; and an audio input component.

19. The device according to claim 18, wherein said audio input component is one of a microphone and an interface to another device.

20. The device according to claim 18, wherein said device is one of a wireless terminal and a network element of a wireless communication network.

21. A system comprising:

an audio encoder including the apparatus according to claim 10; and an audio decoder.

22. A computer program product in which a program code is stored in a computer readable medium, said program code realizing the following when executed by a processor:

determining first autocorrelation values for a segment of an audio signal, wherein a first considered delay range is divided into a first set of a plurality of sections, said first autocorrelation values being determined for delays in a plurality of sections of said first set of sections;

determining second autocorrelation values for said segment of an audio signal, wherein a second considered delay range is divided into a second set of a plurality of sections such that sections of said first set and sections of said second set are overlapping, said second autocorrelation values being determined for delays in a plurality of sections of said second set of sections; and providing said determined first autocorrelation values and said determined second autocorrelation values for an estimation of a pitch lag in said segment of said audio signal.

23. The computer program product according to claim 22, wherein said audio signal is divided into a sequence of frames, and wherein each frame is further divided into a first half frame and a second half frame, and wherein for each frame first and second autocorrelation values are determined separately for said first half frame of said frame as a first segment of said audio signal, for said second half frame of said frame as a second segment of said audio signal and for a first half frame of a subsequent frame as a third segment of said audio signal.

24. The computer program product according to claim 22, wherein said first set of sections and said second set of sections each comprises four sections and wherein said autocorrelation values are determined for delays in at least three sections of each set of sections.

25. The computer program product according to claim 22, wherein said sections in said first set of sections and in said second set of sections are selected such that a section does not comprise pitch lag multiples.

26. The computer program product according to claim 22, said program code further selecting from said provided autocorrelation values a strongest autocorrelation value in each section of each set of sections.

27. The computer program product according to claim 26, said program code further reinforcing selected autocorrelation values that are stable across segments of said audio signal, wherein autocorrelation values that are stable in the same section across segments of said audio signal are reinforced stronger than autocorrelation values that are stable in different sections across segments of said audio signal.

28. The computer program product according to claim 22, wherein said autocorrelation values are determined in the scope of an open-loop pitch analysis.

29. An apparatus comprising:

means for determining first autocorrelation values for a segment of an audio signal, wherein a first considered delay range is divided into a first set of a plurality of sections, said first autocorrelation values being determined for delays in a plurality of sections of said first set of sections;

means for determining second autocorrelation values for said segment of an audio signal, wherein a second considered delay range is divided into a second set of a plurality of sections such that sections of said first set and sections of said second set are overlapping, said second autocorrelation values being determined for delays in a plurality of sections of said second set of sections; and means for providing said determined first autocorrelation values and said determined second autocorrelation values for an estimation of a pitch lag in said segment of said audio signal.

30. The apparatus according to claim 29, further comprising means for selecting from said provided autocorrelation values a strongest autocorrelation value in each section of each set of sections.

31. The apparatus according to claim 30, further comprising means for reinforcing selected autocorrelation values that are stable across segments of said audio signal, wherein autocorrelation values that are stable in the same section across segments of said audio signal are reinforced stronger than autocorrelation values that are stable in different sections across segments of said audio signal.

* * * * *